US006003187A

United States Patent [19]

Footer et al.

[11] Patent Number: 6,003,187

[45] Date of Patent: Dec. 21, 1999

[54] COMBINATION MOP AND WIPER

[75] Inventors: Harold Footer, Newton; Alan D. Ball, Arlington, both of Mass.; Timothy J. Coonahan, Londonderry, N.H.; Philip C. Walker, Arlington; David G. Honan, Concord, both of Mass.

[73] Assignee: Easy Day Manufacturing Company, Holliston, Mass.

[21] Appl. No.: 09/067,063

[22] Filed: Apr. 27, 1998

Related U.S. Application Data

[63] Continuation-in-part of application No. 08/841,441, Apr. 22, 1997, Pat. No. 5,920,942.

[51] Int. Cl.[6] ..... A47L 13/146

[52] U.S. Cl. ..... 15/119.2; 15/121; 15/114; 15/246

[58] Field of Search ..... 15/114, 119.1, 15/119.2, 121, 246

[56] References Cited

U.S. PATENT DOCUMENTS

| | | | |
|---|---|---|---|
| 210,953 | 12/1878 | McCarthy | 15/119.2 |
| D. 327,146 | 6/1992 | Miller . | |
| 947,145 | 1/1910 | Ax . | |
| 2,534,086 | 12/1950 | Vosbikian et al. . | |
| 2,678,458 | 5/1954 | Vosbikian et al. . | |
| 2,715,745 | 8/1955 | Jacobsen . | |
| 2,725,585 | 12/1955 | Vosbikian | 15/119.2 |
| 2,741,788 | 4/1956 | Shey . | |
| 3,631,561 | 1/1972 | Aszkenas . | |
| 3,721,502 | 3/1973 | Ognibene . | |
| 3,968,535 | 7/1976 | Nichols, Jr. . | |
| 4,124,915 | 11/1978 | Schlicher . | |
| 4,312,093 | 1/1982 | Raab . | |
| 4,315,342 | 2/1982 | Ash . | |
| 4,381,575 | 5/1983 | Wendt . | |
| 4,409,700 | 10/1983 | Sullivan . | |
| 4,607,411 | 8/1986 | Lewis, Jr. . | |
| 4,785,489 | 11/1988 | VonDoehren . | |
| 4,893,370 | 1/1990 | Klotz . | |
| 4,910,825 | 3/1990 | Mauer . | |
| 5,429,678 | 7/1995 | Fany . | |
| 5,469,594 | 11/1995 | Nolte . | |
| 5,515,570 | 5/1996 | Muscroft . | |
| 5,539,949 | 7/1996 | Stanton . | |
| 5,575,032 | 11/1996 | Cernuska . | |
| 5,615,449 | 4/1997 | Sepke . | |
| 5,881,424 | 3/1999 | Pleener | 15/121 |

FOREIGN PATENT DOCUMENTS

| | | | |
|---|---|---|---|
| 0087404 | 6/1896 | Germany | 15/119.2 |
| 548683 | 8/1957 | Italy | 15/119.2 |
| 0304665 | 4/1955 | Switzerland | 15/119.2 |
| 0775135 | 5/1957 | United Kingdom | 15/119.2 |

OTHER PUBLICATIONS

Mechanical Sponge Mop Squeezing Device, M.K. Project, Product Literature, Jan. 25, 1997.

*Primary Examiner*—Randall E. Chin
*Attorney, Agent, or Firm*—Wolf, Greenfield & Sacks, P.C.

[57] ABSTRACT

A mop for cleaning a floor includes a handle. A mop head is attached to the distal end of the handle. A sponge having a floor contact surface is removably attached to the mop head. A squeegee, having a floor wiping surface, is formed integral with a front surface of the mop head. The mop also includes a mechanism for wringing the sponge, coupled to the mop head.

11 Claims, 7 Drawing Sheets

COMBINATION MOP AND WIPER

RELATED APPLICATIONS

This application is a continuation-in-part of application Ser. No. 08/841,441, filed Apr. 22, 1997, now U.S. Pat. No. 5,920,942 entitled Combination Mop and Wiper.

BACKGROUND OF THE INVENTION

Mops are floor cleaning implements which include a cleaning element, attached to an elongate handle, that contacts the floor during cleaning and that absorbs (and expels) liquid. Liquid remaining on the floor after mopping can be hazardous and also can reduce the attained cleanliness of the floor. As a result, many mop designs have been aimed at drying a floor surface after cleaning.

Some mops include absorbent sponges which act to absorb liquid remaining on the floor during the cleaning. Such designs have proved unsatisfactory in the level of dryness achieved. Wiping implements, such as those including squeegees attached to the end of a handle, also have been known to be used to wipe an area including liquid and then to separately use a mop including an absorption sponge for drying. Using two separate implements (mop and wiping), however, can be cumbersome. In addition, unless the mop and wiping implement are designed for complementary use, the level of dryness achieved often is unsatisfactory.

Prior art cleaning implements including both a wiping element (squeegee) and a sponge are known. To date, none of such dual element implements has proven to achieve satisfactory cleaning and drying while also being ergonomically easy to use. Some dual element implements include a squeegee and a sponge attached to different sides of the implement's handle, requiring the user to reverse the orientation of the implement to switch from using the sponge to using the squeegee and visa versa.

An example of a prior art cleaning implement including both a wiping element and cleaning element is described in U.S. Pat. No. 5,469,594 to Nolte. The cleaning implement described in Nolte includes a cleaning cloth and a scrapping element located on the same side, and attached to the distal end, of a handle. While the implement disclosed enables both cleaning and wiping without requiring a user to reverse the orientation of the implement, the implement suffers from a number of drawbacks. First, the Nolte implement is not well-suited for floor use due to the relative positions of the cleaning cloth, wiping element, and handle. It is designed specifically for cleaning vertically oriented surfaces, such as windows. Because the handle extends almost parallel to the bottom cleaning surface of the cloth, and because of the angle at which the wiping element extends from the implement, from an ergonomic standpoint, it would be extremely difficult to use the implement to clean floors. Additionally, due to the use of a cloth cleaning element having poor absorption capacity, and due also to the relative positions and spacing between the front of the cloth and the wiping element resulting in a limited wicking action, poor absorption by the cloth of the liquid being wiped results, leaving the floor wet after cleaning. The Nolte implement, because it is designed for cleaning a vertically oriented surface, relies in part on gravity for the liquid being wiped to reach and be absorbed by the cloth. It would be ergonomically difficult to use to clean a floor and would perform in an unsatisfactory manner.

In addition, to Applicant's knowledge, none of the prior art cleaning implements including both a wiping element and cleaning element, also includes a mechanism by which the cleaning element (i.e., sponge) may be wrung out.

SUMMARY OF THE INVENTION

One embodiment of the present invention is directed to a mop for cleaning a floor including a handle. A mop head is attached to one end of the handle. A sponge, having a floor contact surface, is removably attached to the mop head. A squeegee, having a floor wiping surface, is attached to the mop head. The mop further includes a mechanism, coupled to the mop head, for wringing the sponge.

In one embodiment, the mechanism for wringing the sponge includes hinges, integral with the sponge head, that flex inwardly toward the sponge when the sponge is being wrung.

In an embodiment, the squeegee is arranged on the mop head such that the wiping surface of the squeegee is located a predetermined distance from the floor contact surface of the sponge and such that the squeegee is located at a predetermined angle to a line perpendicular to the floor.

In one embodiment, the predetermined distance falls within the range of 10 to 20 mm.

In an embodiment, the predetermined angle falls with the range of 20 to 30 degrees.

In an embodiment, the squeegee is formed integral with the mop head.

In an embodiment, the mop further includes a cover, removably attached to the mop head, to which a brush may be attached.

In an embodiment, the mop further includes a backing plate, removably attached to the mop head, wherein the sponge is attached directly to the backing plate.

Another embodiment of the present invention is directed to a mop for cleaning the floor including a handle. A mop head is attached to one end of the handle. A sponge, having a floor contact surface, is removably attached to the mop head. A squeegee, having a floor wiping surface, is formed integral with the mop head.

In an embodiment, the squeegee is formed integral with the mop head at a central location of the squeegee. The squeegee is spaced from each living hinge of the mop head on either side of the central location.

DETAILED DESCRIPTION

Figure 1:
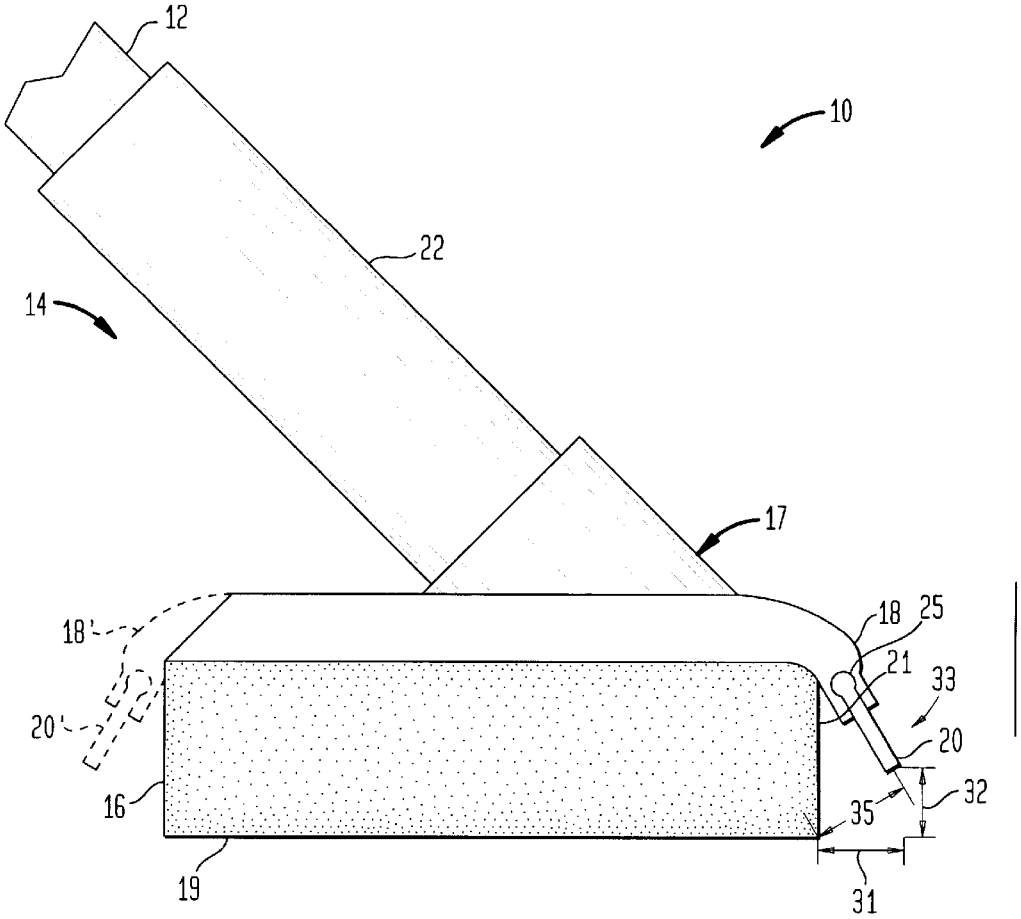
FIG. 1 is a side view of an illustrative mop according to the invention in its mopping position with part of its mop handle cut away and showing an alternative wiper placement.
Figure 2:
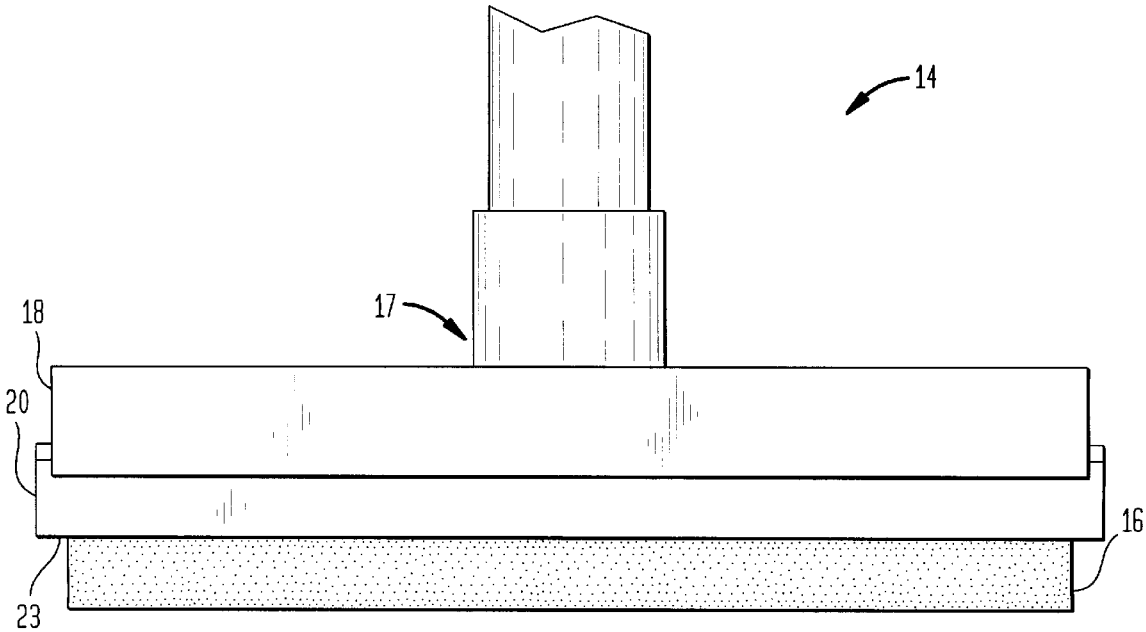
FIG. 2 is a front view of the mop head assembly of the mop of FIG. 1.

Referring to FIGS. 1 and 2, a mop 10 according to an illustrative embodiment of the invention includes a mop handle 12 coupled to a mop head assembly 14. The mop head assembly includes a mop head 17 on which a sponge 16 is mounted. The mop head includes a wiper mount 18, which can hold a wiper 20, such as a resilient squeegee blade. The mop head also includes a coupling 22 to hold the mop handle 12 by its coupling end 13, which is opposite its grip end 15 (see FIG. 3). The mop head can be made of metal, plastic, or any other suitable material that can hold the sponge and wiper in a rigid relationship, although multi-part mop head assemblies that can be disassembled or adjusted are also possible. Note that the interrelationship between the sponge, handle, and squeegee can also be maintained without being directly connected to the mop head (e.g., the wiper could be connected to the handle via an additional part). It is conventional to think of the sponge as being on the bottom of the mop, and the grip end as being at the back of the mop.

Generally, the coupling 22 holds the mop handle 12 at an angle with respect to a working surface 19 of the sponge 16. The wiper mount 18 in the mop head 17 holds the wiper 20 in a position somewhat in front of a front face 21 of the sponge. In one embodiment, a ridge on a top edge 25 of a wiper blade is held in a channel in the wiper mount, but other methods of attaching the wiper can also be used, such as coinjection.

The mop head 17 holds the wiper 20 at an inclination angle 33 from the vertical with its working edge 23 below its top edge 25. The working edge is located at a height 32 above the working surface 19 of the sponge and at a distance 31 in front of the front surface 21 of the sponge (measured with the sponge uncompressed and flat on the floor). Dimension numbers for one illustrative embodiment are listed in Table 1.

TABLE 1

| Dimension | Value |
|---|---|
| Height 32 of Working Edge from Floor | 14 mm |
| Distance 31 from Front Sponge Face to Working Edge | 22 mm |
| Inclination Angle 33 | 26° |

The clearance or height of the working edge from the floor 32 should be at least about 7 mm, preferably around 14 mm, or even 23 mm. The distance 35 from the bottom edge of the front sponge face to the working edge should be below 30 mm, preferably less than 22 mm, or even below 18 mm.

Figure 3:
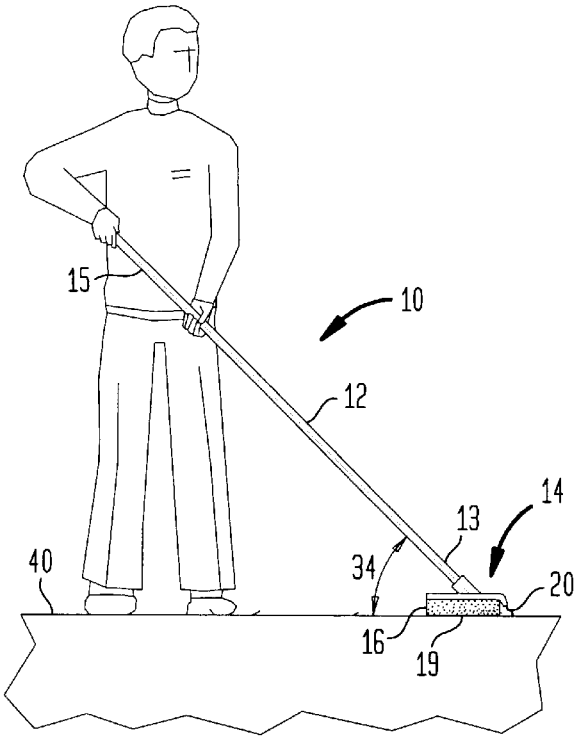
FIG. 3 is a sketch illustrating the use of the mop of FIG. 1 in mopping position.

In operation, referring to FIG. 3, the user of the mop 10 begins by mopping the floor 40 in the usual manner. The wiper 20 generally does not touch the floor during mopping because its working edge 23 is positioned somewhat above the working surface 19 of the sponge 16. This will prevent the wiper from interfering with the mopping operation.

Figure 4:
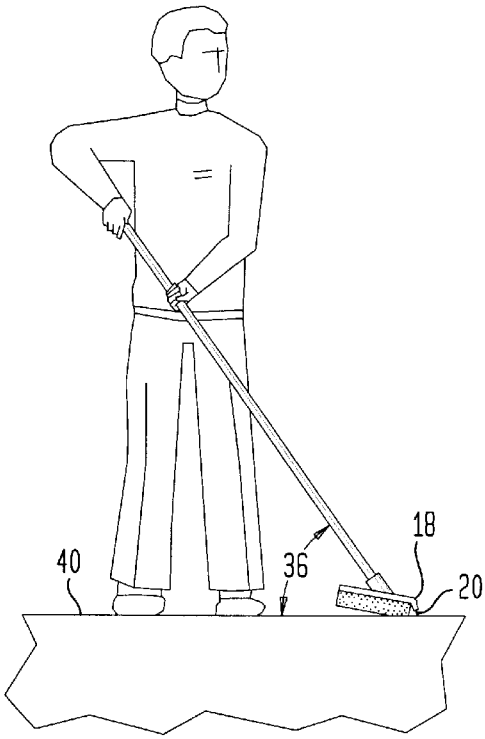
FIG. 4 is a sketch illustrating the use of the mop of FIG. 1 in drying position.

Referring to FIG. 4, once the user has finished mopping the floor 40 or a portion thereof, he or she can wipe the floor or that portion with the working edge 23 of the wiper 20. The user first tilts the mop handle 10 upward until the working edge contacts the floor, and then draws the wiper towards him- or herself to wipe the mopping liquid off of the floor. During this operation, the user will hold the mop with a larger, but still acute, average angle 36 between the mop and the floor, compared with the angle he or she used during mopping (angle 34 in FIG. 3).

Figure 5:
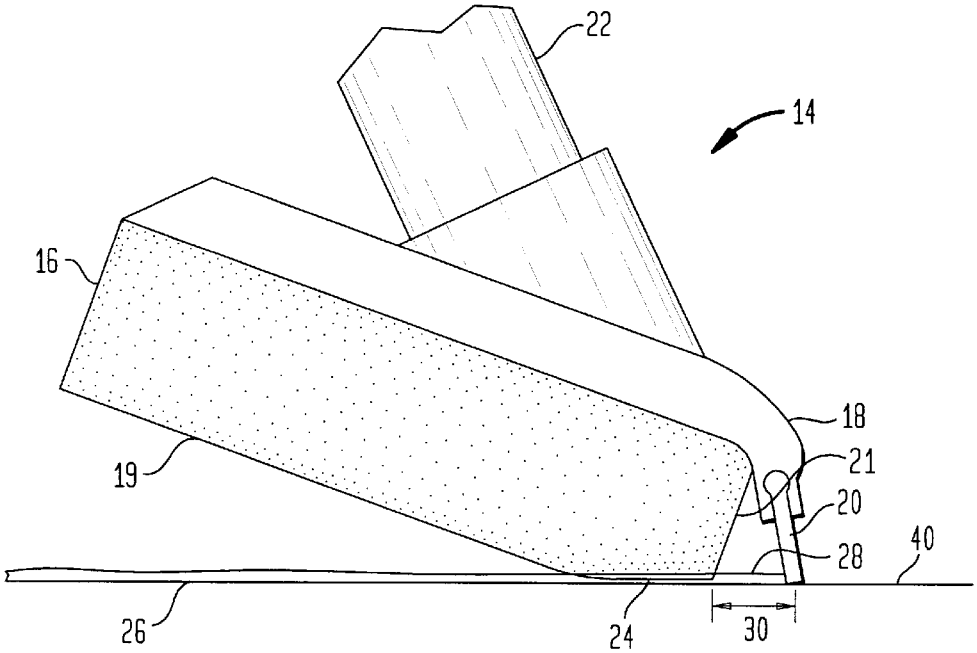
FIG. 5 is a side view of the mop head assembly of FIG. 1 in drying position.

Referring to FIG. 5, a portion 24 of the sponge 16 at the front of the working surface 19 is slightly compressed during drying. As the user draws the sponge along, that portion of the sponge will be pulled over the mopping liquid 26, and may absorb some of it. Substantially all of the remaining mopping liquid 28 will be wiped by the wiper 20 and will form a small pool in the gap 30 that separates the wiper from the front surface 21 of the sponge. The sponge will wick the water in this pool into the sponge as the user pulls the mop, and thereby leave the floor relatively dry at the end of the stroke.

Because the front surface of the sponge wicks away the mopping liquid 28, the use of the mop 10 represents an advantage over separate use of a mop and a squeegee. If a squeegee were used after mopping, it would typically accumulate large pools of water at the end of its stroke and this water would have to be removed from the floor. By mopping as described above, however, the water can simply be wrung out of the sponge. In particular trials, embodiments of the invention have left a smooth synthetic floor surface with only a negligible trace of water after a single stroke of the wiping edge, instead of leaving pools of water. Other types of flooring material or other factors may result in much, but not all, of the water being removed from the floor, but this may still represent a significant improvement over prior art methods. It is also contemplated that somewhat different wiper materials and positions may be used to achieve good results in different conditions.

It is important to keep the working edge 23 of the blade 20 relatively close to the line along which the front surface 21 of the sponge 16 touches the floor 40 (i.e., to keep the gap 30 small). This keeps the mopping liquid in a pool that contacts with the absorbent face of the sponge during drying strokes, and helps to achieve the wicking action. It is generally also important that the blade be in contact with the floor at all times when the mop is in its drying position.

As can be seen from FIGS. 3 and 4, the mop head 17 is designed to position the wiper 20 and the sponge 16 with respect to the handle 12 in such a way that both mopping and drying can be performed while standing with one's arms in a similar comfortable position. To switch from mopping to drying the user need only shift his or her position while keeping his or her hands in the same position relative to the mop handle. He or she need not let go of the mop, turn it over, or grip it in a different way. To this end, the angle between the floor and mop handle 12 in mopping position 34 and the angle between the floor and the mop handle in drying position 36 can be designed to result in the most comfortable operation for the average intended user.

Determining what the actual desired angles should be for the illustrative positions in FIGS. 3 and 4 can be accomplished using well known ergonomic methods, or can be determined empirically based on the preferences of users. It is also possible to design a mop where the angle between the mop and handle and mop head is adjustable, allowing each user to configure the mop according to his or her height, arm length, and individual preferences. It is also possible to include a mechanism to achieve the desired mop head positioning. In one embodiment, the mopping angle 34 is 47° and the drying angle 36 should be less than 90° (i.e., both angles should be acute). Note that there is a trade-off between the working edge clearance 32 and the difference between the mopping position angle 34 and the drying position angle 36. The distance from the front sponge face to the working edge also impacts the difference in the angles, as do other variables. It is therefore desirable to keep the difference in mop handle angles to within user comfort levels while also providing enough clearance for the wiper and an appropriate sponge-face-to-working-edge distance 31. The dimensions should also ensure that the pooling action occurs and allows the drying of the floor.

The sponge should be absorbent enough to absorb the liquid that reaches the absorbent face of the sponge during the drying stroke. Sponges that contain cellulose are well suited, and other materials, such as PVA, can also provide acceptable or even greater performance. To this end, it is contemplated that a sponge with an absorption capacity of at least six times its weight should be used. Sponge absorptivity is measured by immersing a clean dry sponge in water for 30 seconds, allowing it to drip for 30 seconds, and then weighing the wet sponge.

Referring again to FIG. 1, an alternative wiper mount 18' can be provided on the back of the mop head 17. Using this embodiment, the user mops the floor at one angle, and then tilts the mop downward to engage the wiper 20' with the floor. He or she then pushes the mop to wipe the floor. As noted above, it is also possible to use different structures to achieve a desired relative attachment between the sponge, wiper, and handle, instead of attaching them all to a mop head. For example, the wiper could be attached to a wiper mount mounted on the handle but not forming a part of the mop head. Different types of wipers can also be used, such as multi-blade squeegees.

The invention can be applied to a wide variety of mops. For example, a mop employing principles according to the invention can employ a butterfly or other mechanism to allow the user to wring out the sponge. Certain of the novel and unobvious features of the invention could also be applied to other cleaning implements such as hand mops. It is further contemplated that a wiper attachment could be provided for retrofitting to pre-existing mops to obtain a floor mop in accordance with the invention.

Figure 6:
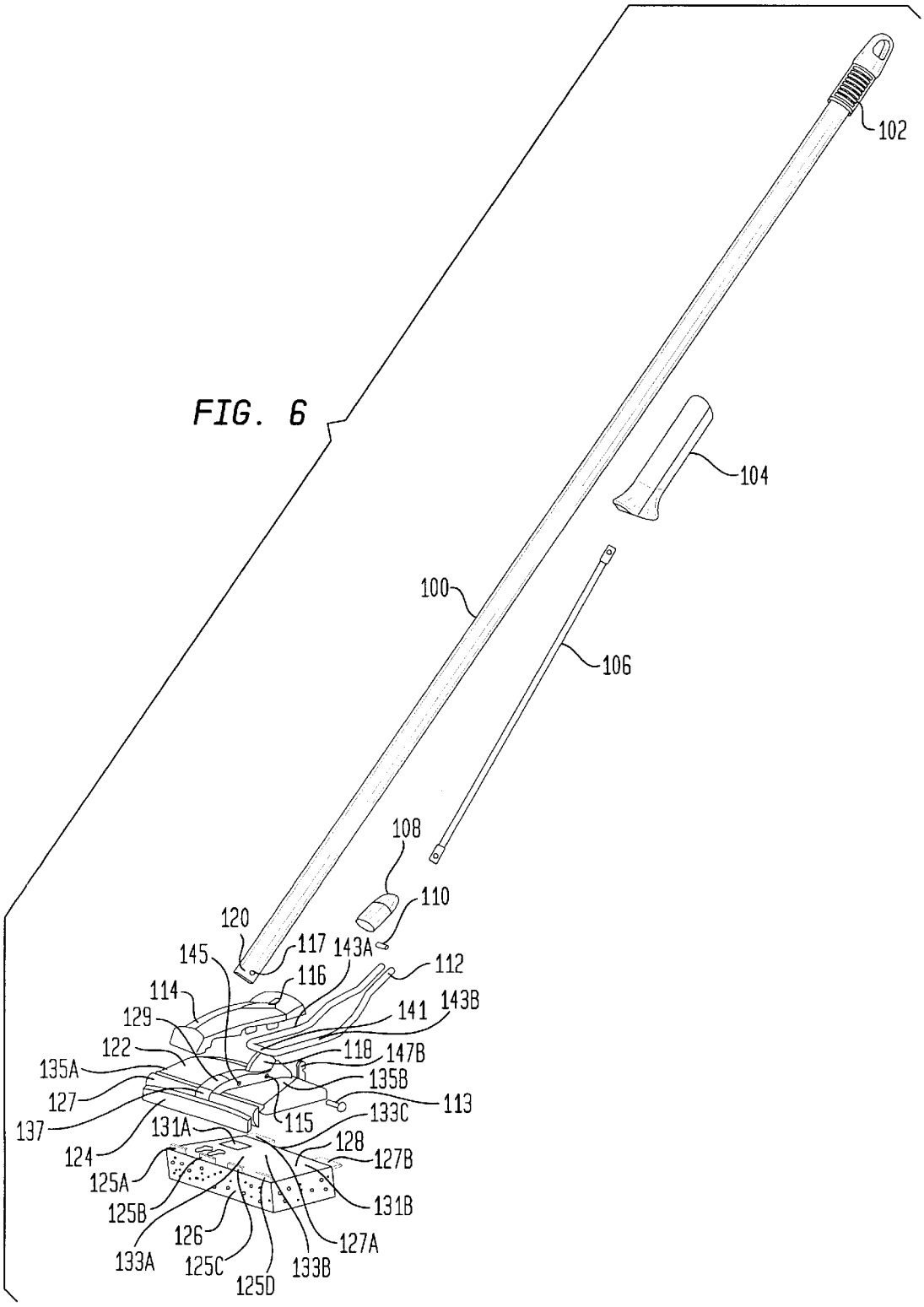
FIG. 6 is an exploded view of a mop according to a preferred embodiment of the invention.

A preferred embodiment of the invention is shown in FIGS. 6–12. Referring to FIG. 6, the mop includes an elongate handle 100, a mop head 122, a sponge 126, and a wringing mechanism for wringing out the sponge.

Handle 100 includes a proximal end having a grip 102 attached thereto, and a distal end 120, to which mop head 122 is attached. Grip 102 may be any conventional grip attached to the proximal end of handle 100. Distal end 120 of handle 100 is inserted into an opening within upwardly extending collar 118. A pin 113 is inserted through opening 115 within neck 118 and also through opening 117 within distal end 120 of handle 100, to retain mop head 122 on distal end of handle 100.

Sponge 126 is attached directly to backing plate 128, which in turn is removably attached to underneath side of mop head 122. Backing plate 128 may be essentially flat on an underneath side, to which sponge 126 is attached. The underneath side may alternatively include ridges or threads. Sponge 126 may be attached to backing plate 128 by any conventional means such as adhesive. Backing plate 128 includes two side hinges 131A and 131B connected by three curved relatively narrow central attaching members 133A, 133B and 133C. Narrow attaching members 133A–133B may flex such that each hinge 131A and 131B moves downwardly toward the other when the sponge is to be wrung, as will be explained in greater detail below.

The top surface of each hinge 131A and 131B includes two upwardly extending T-shaped members, each of which respectively, fits within a square-shaped compartment (not shown) formed by downwardly extending protrusions (also not shown) on the underneath surface of mop head 122 for proper placement of backing plate 128 with respect to mop head 122. Each T-shaped member fits snugly within the corresponding square compartment on the underneath side of the mop head.

For removable attachment of backing plate 128 to mop head 122, a forward facing edge of backing plate 128 includes four L-shaped lip members 125A, 125B, 125C and 125D. The L-shaped lip members extend upwardly and forwardly from a forward upper surface of backing plate 128. Each of lips 125A–125D extends into the corresponding slot 210A–210D on forward facing surface (behind the squeegee) of mop head 122 for aiding in removably retaining backing plate 128 to mop head 122. The number, shape and size of the lip members and the slots are exemplary.

Backing plate 128 also includes two C-shaped members 127A and 127B, attached to a rearward facing surface of backing plate 128 on each hinge 131A and 131B, respectively. Each C-shaped member extends rearwardly from the rearward facing surface of plate 128 such that an opening is located between the rearward facing surface and the C-shaped member. Each C-shaped member 127A and 127B is placed over a corresponding downwardly extending lip (not shown) from a rearward facing surface of mop head 122, such that the lip extends within the opening of the C-shaped member. The positioning of lips 125A–125D within corresponding slots in the forward facing surface of mop head 122 and the positioning of downwardly extending lips from a rearward facing surface of mop head 122 into C-shaped members on the rearward surface of backing plate 128, retains the backing plate, and thereby the sponge, onto an underneath surface of mop head 122. The spacing between the lips 125A–125D and C-shaped members 127A and 127B is approximately equal to the distance between the slots on the forward facing surface of mop head 122 and the lips on the rearward facing surface of mop head 122, such that backing plate 128 is retained tightly on mop head 122. To remove backing plate, and thereby sponge 126, from mop head 122, the C-shaped members 127A and 127B are pulled rearwardly and then are removed from the downward facing lips of mop head 122 enabling the lips 125A–125D to be removed from the forward facing slots of mop head 122.

Mop head 122 is formed with an upwardly extending central channel 129 from which collar 118 extends. On either side of central column 129 is located two relatively flat hinges 135A and 135B. While hinges 135A and 135B are formed integral with collar 129, a crease exists between each of hinges 135A and 135B and collar 129 such that each of the hinges 135A and 135B flex downwardly toward the sponge from collar 129 during wringing of the sponge, as will be explained in greater detail below.

Longitudinal squeegee receiving element 127 is formed integral with mop head 122 at a central location 137 of a squeegee receiving element 127. Column 129 of mop head 122 is co-extensive with central location 137 of squeegee receiving element 127. Either side of central location 137 of squeegee receiving element 127 is spaced from a front surface of a mop head 122, as can be seen better in FIG. 9. The space enables the hinges 135A and 135B of mop head 122 to flex with respect to column 129 and with respect to squeegee receiving element 127.

Squeegee 124 is formed integral with, or alternatively is affixed to, a forward facing portion of squeegee receiving element 127. An upper portion of squeegee 124 is located within a shoulder receiving portion 139 of squeegee receiving element 127. Squeegee 124 may be attached adhesively within shoulder 139 to squeegee receiving element 127. Alternatively, as noted, squeegee 124 may be formed integral with squeegee receiving element 127. Mop head 122 is formed of a flexible yet strong material, which also has elastic qualities such that it may flex and return to its at rest position, such as polypropylene. The entire mop head 122, including co-extensive squeegee receiving portion 127, may be formed of a single piece of molded plastic.

Figure 10:
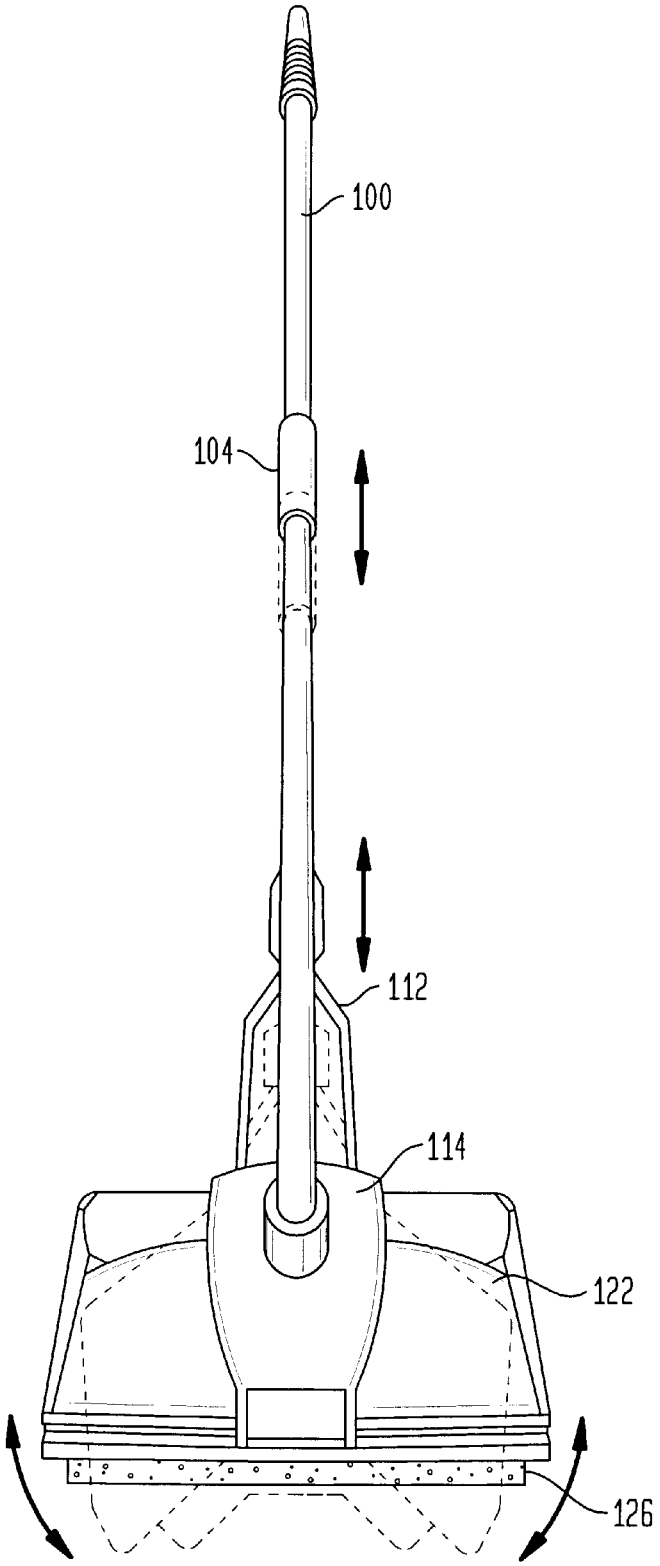
FIG. 10 is a front view of the mop of FIG. 6 illustrating the wringing of the mop.

The wringing mechanism consists of a handle 104, a rod 106, a collar 108, a pin 110 and a bracket 112. Handle 104 is hollow and is placed about elongate handle 100 of the mop. Handle 104 may slide back and forth along handle 100 of the mop. A proximal end of rod 106 is attached to handle 104 by a pin (not shown). To distal end of rod 106 is attached bracket 112 by pin 110. A joint is formed at the connection of rod 106 to bracket 112 such that as handle 104 is slid downwardly along elongate handle 100 of mop toward the distal end thereof, bracket 112 is pushed downwardly. Collar 108 covers the joint connection between rod 106 and bracket 112. Bracket 112 has a U-shaped distal section which abuts against an upper surface of mop head 122. Sides 143A and 143B of U-shaped section 141 of bracket 112 respectively abut against hinges 135A and 135B. End portion of U-shaped distal section 141 extends through hole 145 of collar 129 and sides 143A and 143B extend outwardly of, and are retained by, shoulder elements 147A and 147B (only shoulder 147B is illustrated in FIG. 6). Bracket 112 thereby is retained on mop head 122. As is illustrated in FIG. 10, as handle 104 is slid distally along handle 100, rod 106 causes bracket 112 to press downwardly against an upper surface of mop head 122 causing hinges 135A and 135B to flex downwardly (shown in phantom in FIG. 10), thereby wringing sponge 126.

The mop in one embodiment also includes a cover 114 which mates with, and is retained against, an upper surface of mop head 122. Cover 114 includes an opening 116 through which handle 100 extends. Cover 114 includes a front surface area 132 to which a brush may be attached. Brush may be attached by any suitable means such as adhesive, hook and loop fastener, etc.

Figure 7:
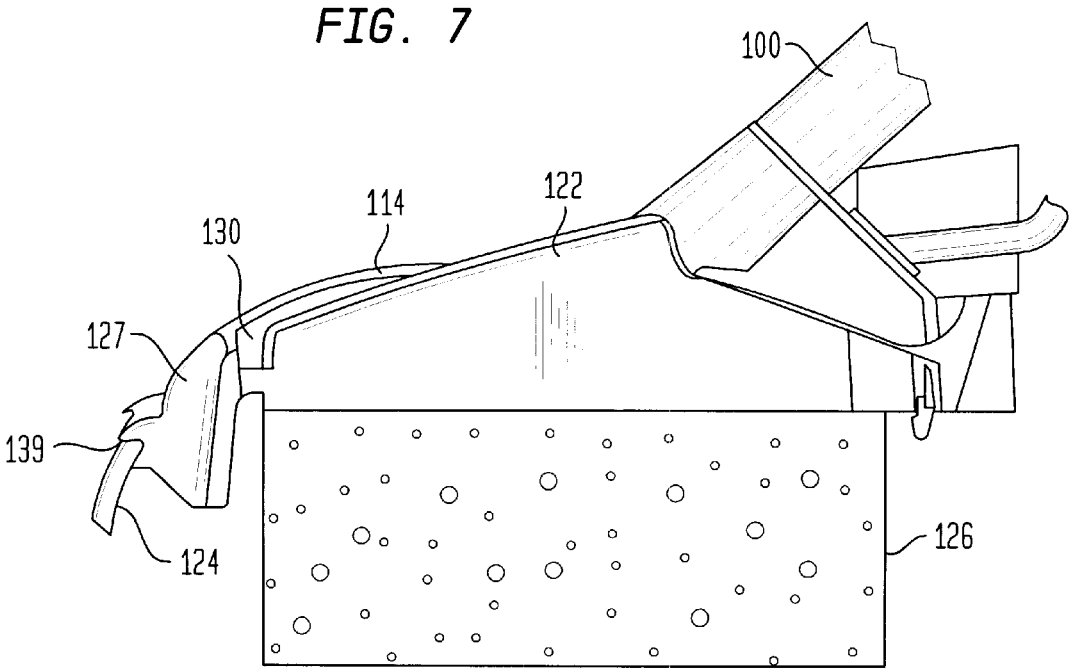
FIG. 7 is a side view of the mop head of the mop of FIG. 6.
Figure 8:
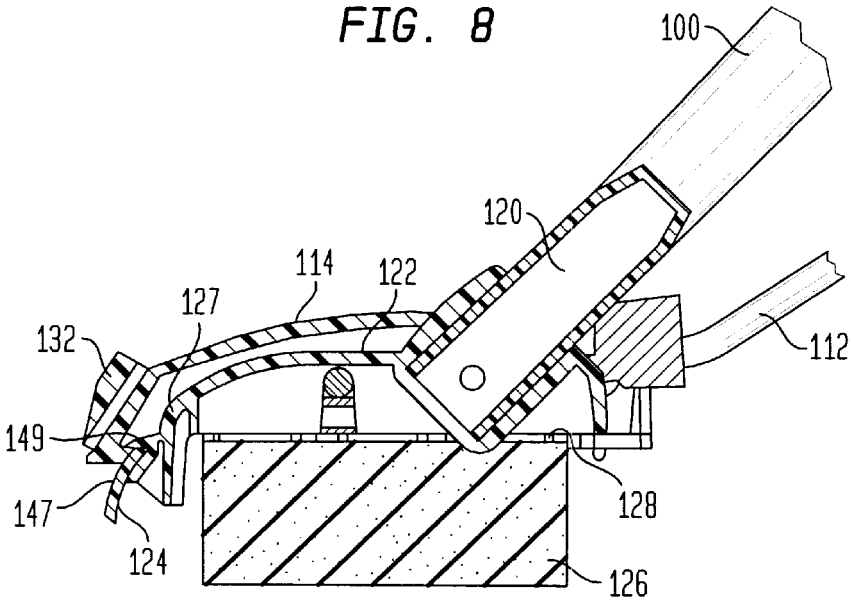
FIG. 8 is a cross-sectional side view of the mop head of FIG. 7.
Figure 9:
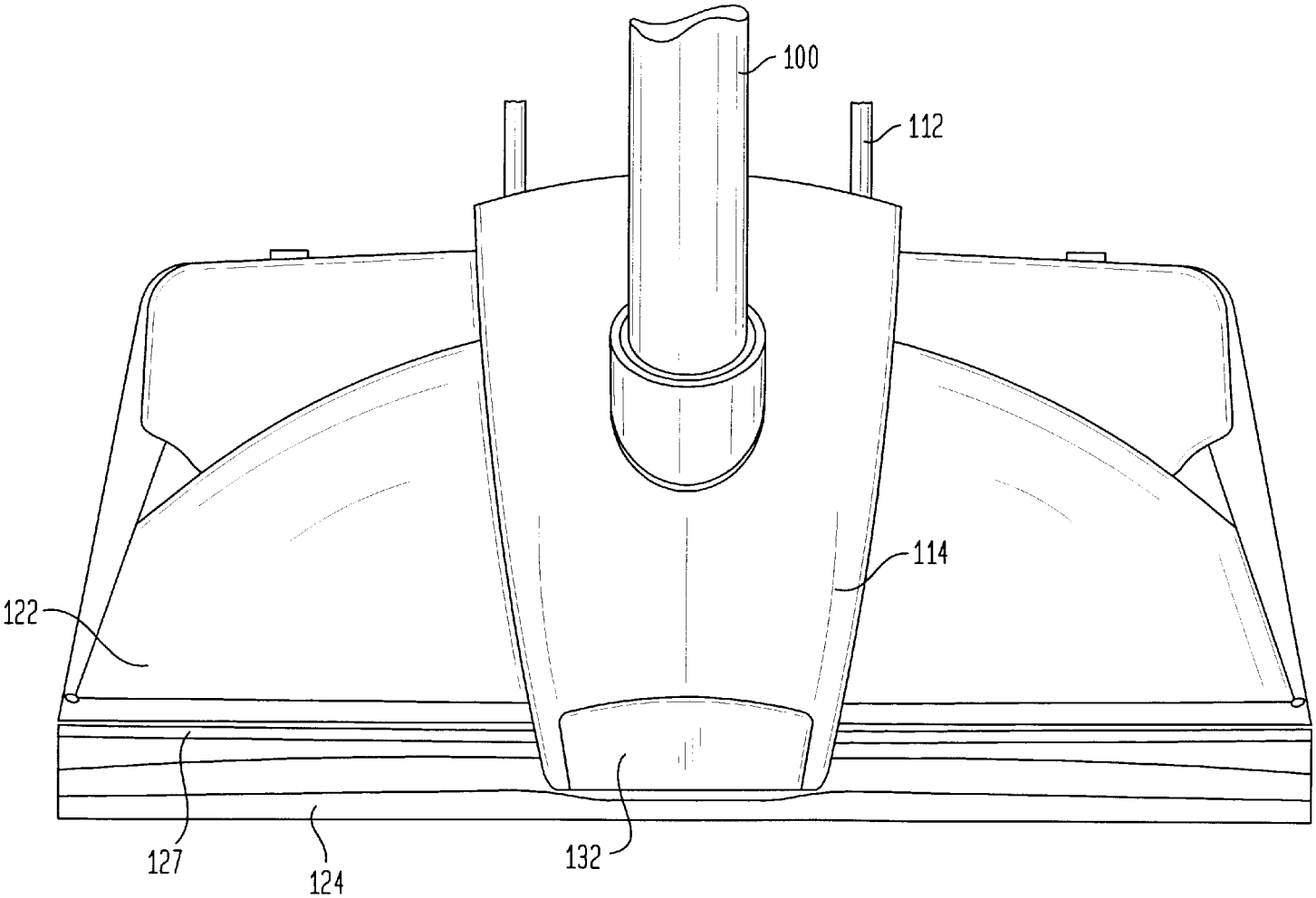
FIG. 9 is a front view of the mop head of the mop of FIG. 6.

As can be seen better from FIGS. 7 and 8, cover 114 has an underneath surface which mates with the upper surface of mop head 122. Cover 114 is retained on mop head 122 by the extension of handle 100 through opening 116 and also by the mating of a front shoulder portion 147 (on underneath surface of cover 114) with lip 149 of squeegee receiving member 127.

Figure 11:
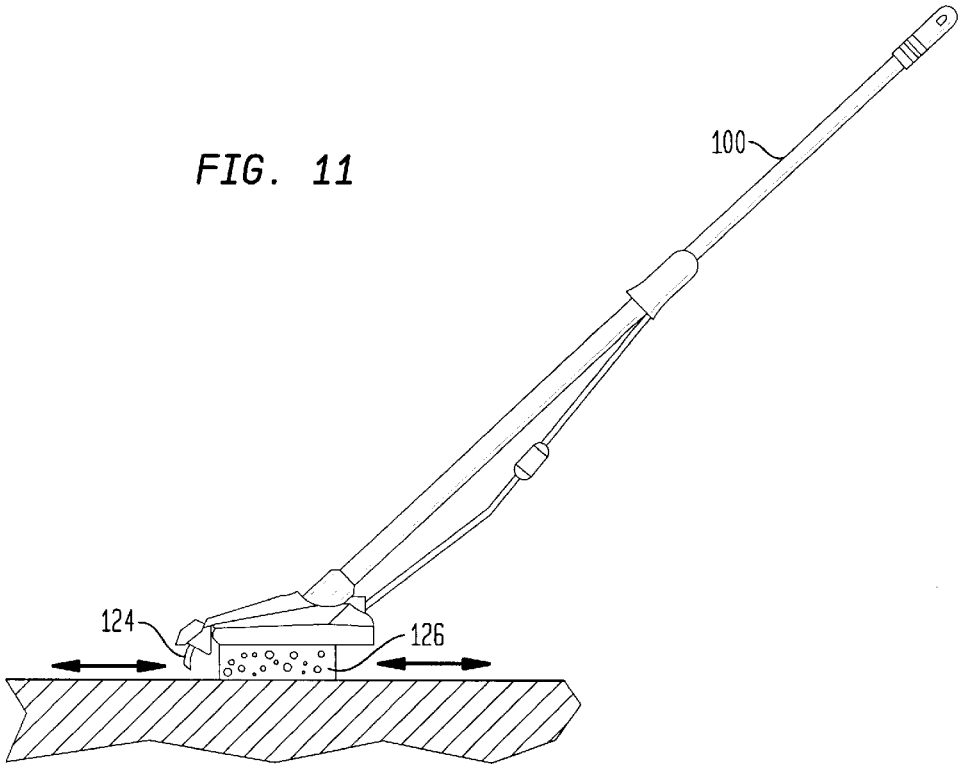
FIG. 11 is a side view of the mop of FIG. 6 illustrating the use of the mop in the cleaning position.
Figure 12:
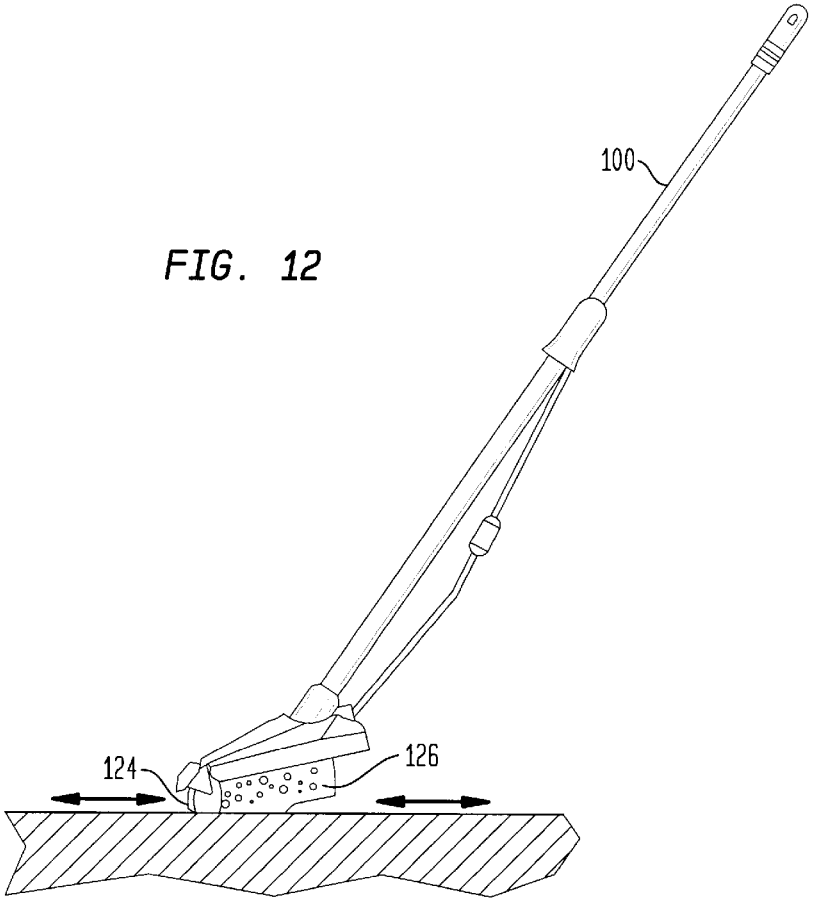
FIG. 12 is a side view of the mop of FIG. 6 illustrating the use of the mop in the drying position.

The mop of this preferred embodiment thus enables cleaning by the mop with sponge 126 contacting the surface to be cleaned (as shown in FIG. 11) as well as the drying of the surface with both sponge 126 and squeegee 124 contacting the surface (as shown in FIG. 12). Between cleaning (FIG. 11 position) and drying (FIG. 12 position), the sponge can be wrung out with the sponge element itself. The positioning of the sponge with respect to the squeegee, the distance between the two, the angle of the squeegee with respect to the front surface of the sponge, the distance of the wiping surface of the squeegee with respect to the surface to be cleaned when the bottom surface of the sponge is in contact with the surface to be cleaned, and the positioning of the handle 100 with respect to the mop head, all are selected specifically to accomplish significant wicking and absorption of the sponge during drying, and to enable mopping and drying that is ergonomically comfortable to the user. In addition, the mop can be used for cleaning, then can be wrung out using an integral wringing mechanism, then can be used for drying, simply by tilting the angle of the handle. Thus mopping and drying can be accomplished easily and effectively with the mop of the present invention.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. A mop for cleaning a floor comprising:

a handle;

a mop head attached to one end of the handle;

a sponge, attached to the mop head, having a floor contact surface;

a squeegee, attached to the mop head, having a floor wiping surface; and a mechanism for wringing the sponge coupled to the mop head;

wherein the mechanism includes hinges, integral with the mop head, that flex inwardly toward the sponge along a path substantially parallel to a longitudinal axis of the squeegee; and wherein the mechanism and squeegee are constructed and arranged such that the squeegee is stationary relative to the mop head when the hinges flex inwardly.

2. The apparatus claimed in claim 1 wherein the squeegee is arranged on the mop head such that the floor wiping surface of the squeegee is located a predetermined distance from the floor contact surface of the sponge and such that the squeegee is located at a predetermined angle to a line perpendicular to the floor.

3. The apparatus claimed in claim 1 wherein the squeegee is formed integral with the mop head.

4. The apparatus claimed in claim 1 further including a cover, removably attached to the mop head, to which a brush may be attached.

5. The apparatus claimed in claim 1 further including a backing plate removably attached to the mop head, the sponge being attached directly to backing plate.

6. A mop for cleaning a floor comprising:

a handle;

a mop head attached to one end of the handle;

a sponge, attached to the mop head, having a floor contact surface;

a squeegee, attached to the mop, having a floor wiping surface; and a mechanism for wringing the sponge coupled to the mop head;

wherein the squeegee is arranged on the mop head such that the floor wiping surface of the squeegee is located a predetermined distance from the floor contact surface of the sponge and such that the squeegee is located at a predetermined angle to a line perpendicular to the floor; and wherein the predetermined distance falls within the range of 10 to 20 mm.

7. A mop for cleaning a floor comprising:

a handle;

a mop head attached to one end of the handle;

a sponge, attached to the mop head, having a floor contact surface;

a squeegee, attached to the mop, having a floor wiping surface; and a mechanism for wringing the sponge coupled to the mop head;

wherein the squeegee is arranged on the mop head such that the floor wiping surface of the squeegee is located a predetermined distance from the floor contact surface of the sponge and such that the squeegee is located at a predetermined angle to a line perpendicular to the floor; and wherein the predetermined angle falls within the range of 20 to 30°.

8. A butterfly mop for cleaning a floor comprising:

a handle;

a mop head attached to one end of the handle;

a sponge, attached to the mop head, having a floor contact surface;

a squeegee, attached to the mop head, having a floor wiping surface; and a wringing mechanism including two hinges which flex inwardly along a path substantially parallel to a longitudinal axis of the squeegee to compress the sponge while the squeegee remains stationary relative to the mop head.

9. The apparatus claimed in claim 8 wherein the squeegee is arranged on the mop head such that the floor wiping surface of the squeegee is located a predetermined distance from the floor contact surface of the sponge and such that the squeegee is located at a predetermined angle to a line perpendicular to the floor.

10. The apparatus claimed in claim 8 further including a cover, removably attached to the mop head, to which a brush may be attached.

11. The apparatus claimed in claim 8 wherein a central location of the squeegee is formed co-extensive with the mop head, and either side of the central location of the squeegee is spaced from the mop head.

* * * * *